US009511922B1

(12) United States Patent
Breedwell

(10) Patent No.: US 9,511,922 B1
(45) Date of Patent: Dec. 6, 2016

(54) FRESH MELON AND PRODUCE BAG

(71) Applicant: Ray Breedwell, Apopka, FL (US)

(72) Inventor: Ray Breedwell, Apopka, FL (US)

( * ) Notice: Subject to any disclaimer, the term of this patent is extended or adjusted under 35 U.S.C. 154(b) by 0 days.

(21) Appl. No.: 14/261,686

(22) Filed: Apr. 25, 2014

Related U.S. Application Data

(60) Provisional application No. 61/885,695, filed on Oct. 2, 2013.

(51) Int. Cl.

| | |
|---|---|
| ***B65D 81/34*** | (2006.01) |
| ***B65D 30/00*** | (2006.01) |
| ***B65D 33/00*** | (2006.01) |
| ***B65D 33/25*** | (2006.01) |
| ***B65B 5/04*** | (2006.01) |

(52) U.S. Cl.
CPC ..... *B65D 81/34* (2013.01); *B65B 5/045* (2013.01); *B65D 29/00* (2013.01); *B65D 33/00* (2013.01); *B65D 33/25* (2013.01)

(58) Field of Classification Search
CPC ..... F25D 3/08; B65D 77/04; B65D 31/12; B65D 81/3897; B65D 33/00; B65D 29/00; B65D 5/045; B65D 81/34; B65D 33/25; A45C 11/20; A45C 7/0086; A45C 7/009; A45C 3/08; A45C 2013/026; A45C 3/04; A45C 7/0077
USPC ..... 383/38, 39, 40, 110, 37
See application file for complete search history.

(56) References Cited

U.S. PATENT DOCUMENTS

| | | | | |
|---|---|---|---|---|
| 306,863 | A | 10/1884 | Robinson | |
| 719,810 | A | 2/1903 | Jones | |
| 978,429 | A | 12/1910 | Barnett | |
| 986,573 | A | 3/1911 | Jackson | |
| 1,017,721 | A | 2/1912 | Williams | |
| 1,070,489 | A | 8/1913 | Kuroda | |
| 1,137,303 | A | 4/1915 | Carpenter | |
| 1,166,707 | A | 1/1916 | Munroe | |
| 1,454,779 | A | 5/1923 | Wells | |
| 1,875,585 | A | 9/1932 | Freimann | |
| 1,992,849 | A | 2/1935 | Walter | |
| 2,130,976 | A | 9/1938 | Stone | |
| 2,163,501 | A | 6/1939 | Speicher | |
| 3,053,005 | A | 9/1962 | Byers | |
| 4,102,376 | A | 7/1978 | Sharp | |
| 4,127,155 | A * | 11/1978 | Hydorn | A45C 13/02 383/106 |
| 4,185,673 | A | 1/1980 | Daniello | |
| 4,403,636 | A | 9/1983 | Lopez | |
| 4,691,370 | A | 9/1987 | MacFee | |
| 4,768,233 | A | 9/1988 | Grilliot | |
| 4,793,532 | A | 12/1988 | Cash | |
| 4,815,640 | A | 3/1989 | Johnson | |
| 4,925,071 | A | 5/1990 | Fleming | |
| 4,927,046 | A | 5/1990 | Armstrong | |
| 5,050,998 | A | 9/1991 | Wachtel | |
| 5,201,446 | A | 4/1993 | Martin | |
| 5,361,603 | A * | 11/1994 | Merritt-Munson | A45C 11/008 220/592.25 |
| 5,645,205 | A * | 7/1997 | Kennedy | A45C 11/22 224/664 |
| 6,190,710 | B1 * | 2/2001 | Nir | A23B 7/148 383/103 |
| 6,336,340 | B1 * | 1/2002 | Laby | A61J 1/165 62/371 |
| 6,821,018 | B1 * | 11/2004 | Denko | A45C 11/22 206/811 |
| 7,538,621 | B2 | 5/2009 | Birleson | |
| 2004/0237166 | A1 * | 12/2004 | Holden | A41D 27/20 2/69 |
| 2005/0111764 | A1 * | 5/2005 | Solder | B65D 31/12 383/38 |
| 2009/0052809 | A1 * | 2/2009 | Sampson | 383/38 |

* cited by examiner

*Primary Examiner* — Jes F Pascua
*Assistant Examiner* — Matthew Theis

(57) ABSTRACT

Bags, containers, apparatus, systems and methods of storing produce, such as fruits and/or vegetables in sealable plastic bags that are each placed into zippered fabric bags having compartments to preserve the fruit and vegetable contents and delay spoilage of the stored fruits and vegetables.

8 Claims, 4 Drawing Sheets

FRESH MELON AND PRODUCE BAG

This application claims the benefit of priority to U.S. Provisional Patent Application Ser. No. 61/885,695 filed Oct. 2, 2013, which is incorporated by reference in its' entirety.

FIELD OF INVENTION

This invention relates to preserving fruits and vegetables, and in particular to bags, containers, apparatus, systems and methods of storing fruits and vegetables in plastic bags that are placed into fabric bags having compartments to preserve the contents and delay spoilage.

BACKGROUND AND PRIOR ART

Consumers often need to eat fruits and vegetables soon after being purchased or they run the risk of fruits and vegetables becoming spoiled and rotten within a short time span. In view of the short shelf life, fruits and vegetable are often thrown away after a day or a few days from the date they are purchased.

It is also common for consumers to leave fruits such as bananas and mangoes, out in a bowl, but they often become spoiled fairly quickly just sitting in an environment under room temperatures.

Cooling the fruits and vegetables in a common refrigerator is popular for storing fruits and vegetables and can delay the spoilage, but only for a short additional time.

As such, consumers often have to throw out fruits such as bananas, mangoes, and the like, when they start to turn bad, such as turn black.

Over the years storage containers, such as plastic box containers have been used. However, such containers are bulky and generally take up more space than what is needed. Additionally, such bulky containers, such as Tupperware containers can be expensive and be further undesirable.

Other containers, such as zip lock bags are also popular, but they also do little to delay the spoilage of the fruits and vegetables.

Thus, the need exists for solutions to the above problems with the prior art.

SUMMARY OF THE INVENTION

A primary objective of the present invention is to provide bags, containers, apparatus, systems and methods of storing fruits in plastic bags that are placed into fabric bags having compartments to preserve the contents and delay spoilage.

A secondary objective of the present invention is to provide bags, containers, apparatus, systems and methods of storing vegetables in plastic bags that are placed into fabric bags having compartments to preserve the contents and delay spoilage.

A third objective of the present invention is to provide bags, containers, apparatus, systems and methods of storing both fruits and vegetables in plastic bags that are placed into fabric bags having compartments to preserve the contents and delay spoilage.

A bag arrangement for preserving and delaying spoilage of fruits and vegetables, comprising a plastic sealable bag adapted for storing produce selected from at least one fruit or at least one vegetable therein, and a closeable fabric bag for receiving the plastic bag with the produce, wherein produce is preserved and spoilage is delayed. The plastic bag can include a plastic zipper fastener. The fabric bag can include a zipper fastener.

The produce can include bananas, mangos, tomatoes, cucumbers, and the like, and any combination thereof of different vegetables and different fruits.

A plural compartment bag system for preserving and delaying spoilage of fruits and vegetables, can include a closeable fabric bag having closed sides and closed bottom and open top which is closeable by fasteners, and at least two compartments inside the fabric bag, and at least two plastic resealable sealable bag adapted for storing produce selected from at least one fruit or at least one vegetable therein, each of the plastic bags being inserted in each of the compartments of the fabric bag, wherein the produce is preserved and spoilage is delayed.

The at least two compartments can include three resealable fabric compartments, and the at least two resealable plastic bags includes three resalable plastic bags. The fasteners on the fabric bag can include a zipper.

A method of preserving and delaying spoilage of produce, can include the steps of providing a fabric bag having closed sides, and a closed bottom and an upper opening for being closed and opened, providing a resealable plastic bag having closed sides, closed bottom and open top that is resealable and reusable, inserting at least one piece of produce in the open top of the plastic bag, closing the open top to reseal the plastic bag with the produce, inserting the resealed plastic bag with the produce in the upper opening of the fabric bag, closing the upper opening of the fabric bag; and preserving the produce inside the plastic bag and delaying spoilage of the produce for at least several days.

The method can further include the step of providing a zipper to close the upper opening of the fabric bag.

The method can further include the step of resealing the open top of the plastic bag with male and female fasteners.

The method can further include the steps of providing plural recloseable compartments inside of the fabric bag, providing plural resealable plastic bags, inserting at least one piece of produce in each of the plural plastic bags, resealing each of the plastic bags that each have at least one piece of produce; inserting each of the plastic bags with the at least one piece of produce in each of the compartments of the fabric bags, closing each of the compartments of the fabric bag that each hold a plastic bag with the at least one piece of produce, and preserving each of the pieces of the produce being stored in each of the resealed plastic bags that are each stored in each of the closed compartments inside of the fabric bag.

The method can further include the step of providing plural recloseable compartments includes the step of providing three recloseable compartments, and the step of providing the plural resealable plastic bags includes the step of providing three plural resealable plastic bags.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
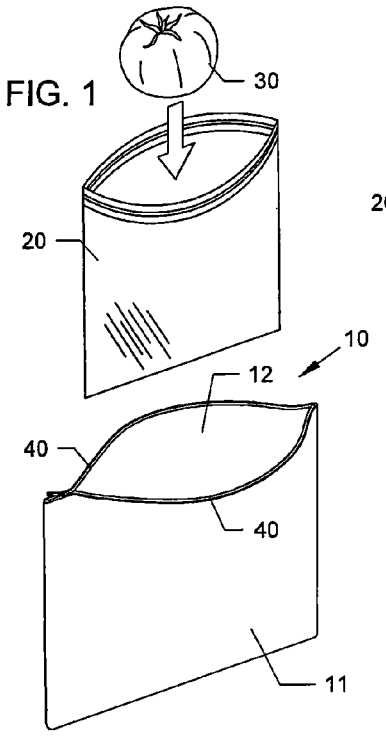
FIG. 1 is a perspective view of produce preserver bag showing a bag open with a sealable plastic bag and a piece of produce ready to be put into the preserver.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

10 Single compartment produce preserver bag.
11 Bag front panel.
12 Bag rear panel.
20/20A/20B/20C resealable plastic bag with resealable top.
30/30A/30B/30C Produce such as vegetables and/or fruit.
40 Zipper closure on main preserver bag.
41 Zipper closures on internal compartments.
50 Triple compartment produce preserver bag. In addition to the large central compartment, a smaller discrete zippered compartment is sewn into the inside of the front and the back walls of the larger bag.
60 Front internal zippered compartment of the triple compartment produce bag.
61 Front internal compartment panel. The side and bottom edges of this panel are stitched to the bag front panel to form a pocket. A zipper is stitched to the top of the panel and to the bag front panel to form a closure.
70 Main central pocket of the triple compartment produce bag.
80 Rear internal zippered compartment of the triple compartment produce bag.
81 Rear internal compartment panel. This panel is attached to the bag rear panel in the same way as the front internal compartment panel.
90 Front to back panel stitching.
100 Front compartment panel to front panel stitching.
110 Rear compartment panel to rear panel stitching.
120 Main compartment zipper stitching.
130 Internal compartment zipper stitching.

Single Compartment Produce and Fruit Preserver Bag

FIG. 1 is a perspective view of produce preserver bag 10 showing the bag 10 open with an open resealable plastic bag 20 and a piece of produce such as vegetables and/or fruit 30, such as but not limited to a tomato, and the like, ready to be put into the preserver.

Figure 2:
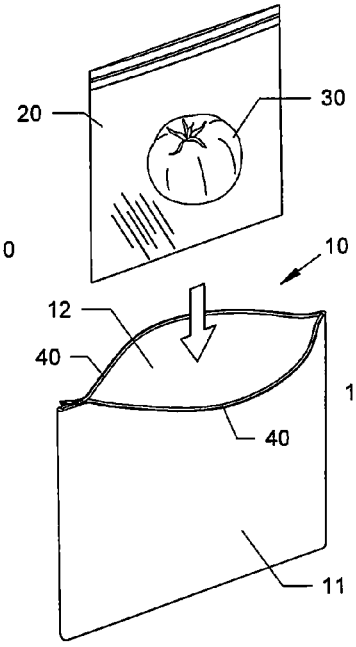
FIG. 2 shows the preserver bag of FIG. 1 with the produce in the resealable bag.
Figure 3:
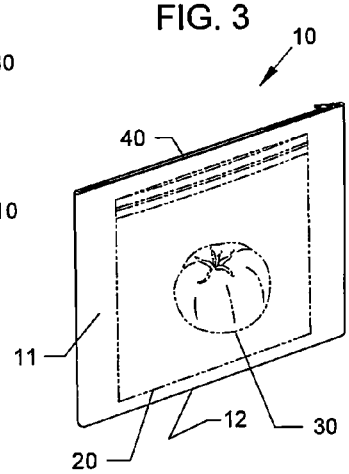
FIG. 3 shows the produce preserver bag of the preceding figures containing a piece of produce sealed into the resealable bag and then zipped into the preserver.

FIG. 2 shows the preserver bag of FIG. 1 with the produce 30 in the resealable bag 20. FIG. 3 shows the produce preserver bag 10 of the preceding figures containing a piece of produce 30 sealed into the resealable plastic bag 20 and then zipped into the preserver bag 10.

The resealable preserver bag 10 can be formed from fabric, and the like, having a bag front panel 11, sealed on the sides and bottom (by being sewn, and the like) to a rear panel 12. A zipper type fastener 40 can open and close the top opening to the preserver bag 10.

The resealable plastic bag 20 can be a plastic type sandwich bag, and the like, with a resealable fastener top with interlocking male and female locking fasteners such as the channel and track fasteners, manufactured by S. C. Johnson & Son, Inc. of Racine, Wis., under the brand name ZIPLOC®.

Plural Compartment Preserver Bag for Produce and Fruit

Figure 4:
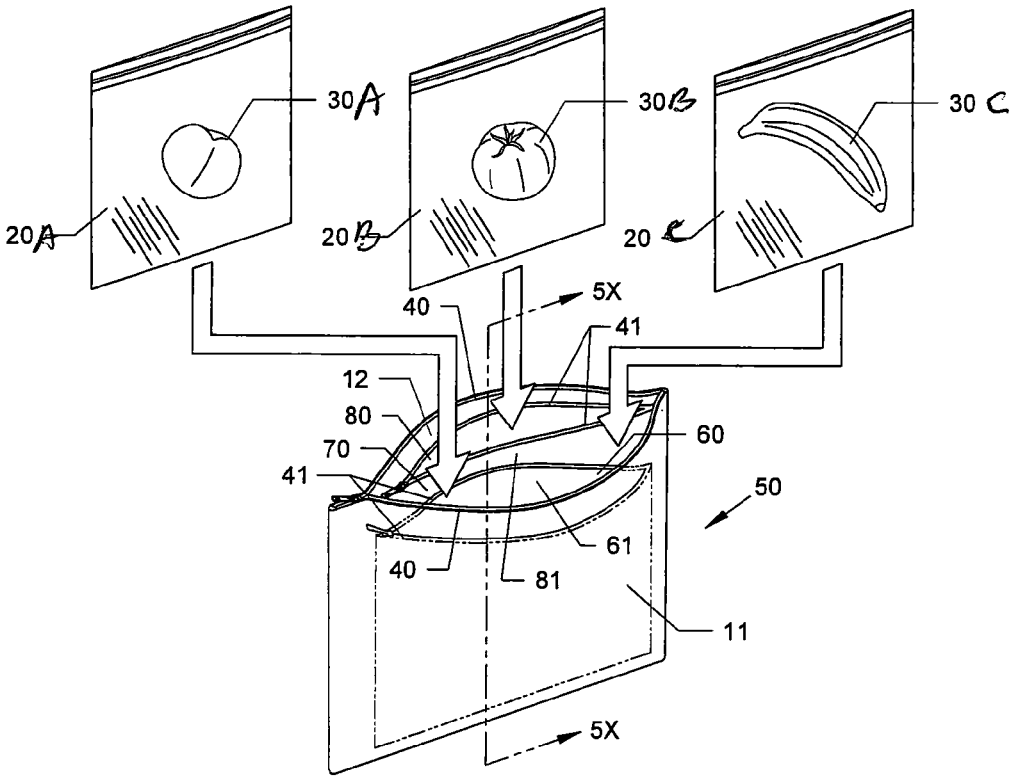
FIG. 4 is a perspective view of an alternate embodiment produce preserver bag having three discrete compartments, along with three pieces of produce sealed into three resealable bags positioned to be inserted into the three discrete compartments of the preserver bag.

FIG. 4 is a perspective view of an another produce preserver bag 50 having three discrete compartments, along with three pieces of produce 30A, 30B, 30C sealed into three resealable bags 20A, 20B, 20C positioned to be inserted into the three discrete compartments 60, 70, 80 of the preserver bag 50.

Figure 5A:
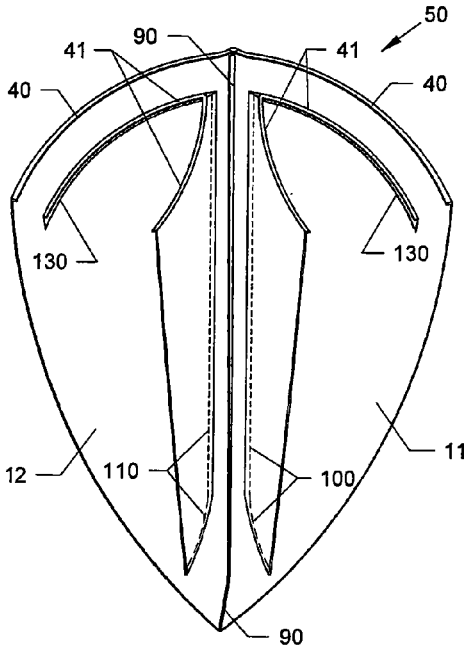
FIG. 5A is a cross-sectional view of the preserver bag of FIG. 4 showing the internal compartments without resealable bags inserted.

FIG. 5A is a cross-sectional view of the preserver bag 50 of FIG. 4 along arrow 5X showing the internal compartments 60, 70, 80 without resealable bags 30A, 30B, 30C inserted inside of the compartments 60, 70, 80.

Figure 5B:
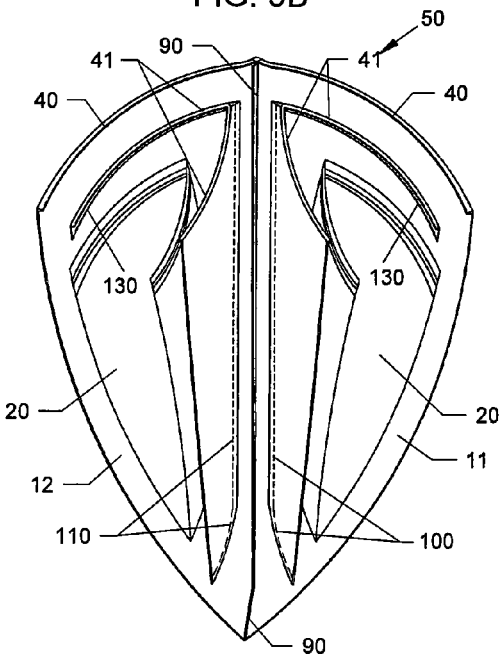
FIG. 5B is another cross-sectional view of the preserver bag of FIG. 4 showing the internal compartments with the resealable bags inserted into the compartments.

FIG. 5B is another cross-sectional view of the preserver bag 50 of FIG. 4 showing the internal compartments 60, 70, 80 with the resealable bags 30A, 30B, 30C inserted into the compartments 60, 70, 80.

Figure 6:
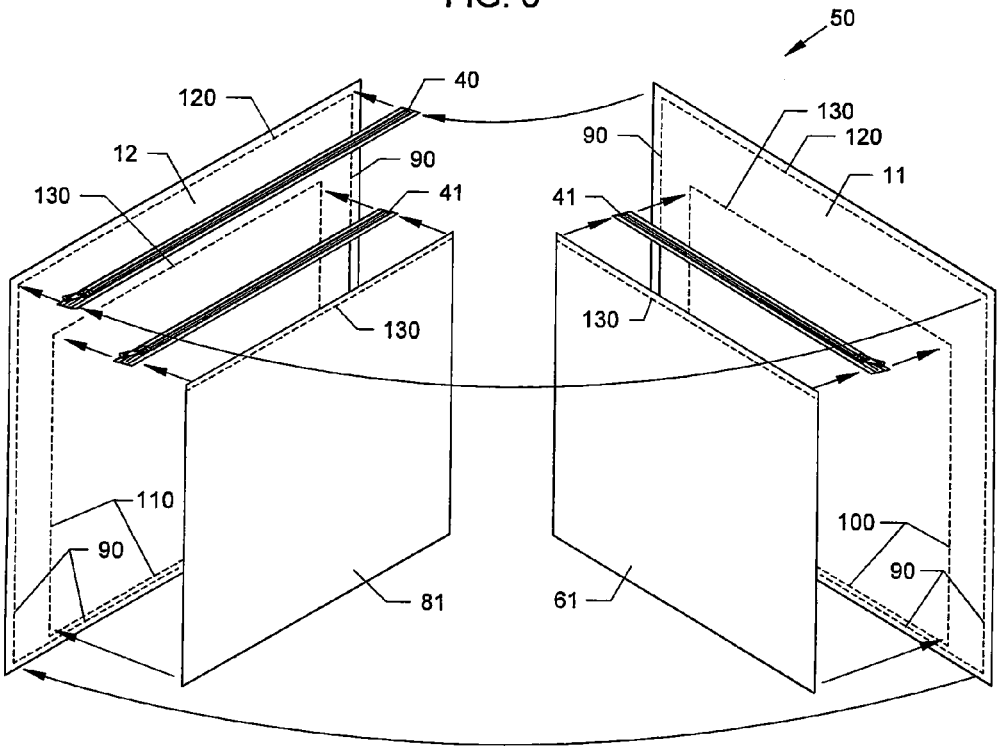
FIG. 6 is a view of the alternate embodiment of FIGS. 4-5B, showing the method and sequence of assembly.

FIG. 6 is a view of the embodiment of FIGS. 4-5B, showing the method and sequence of assembly of the preserver bag 50.

Referring to FIGS. 4-6, the preserver bag 50 can be formed from a fabric material, and have outer front panel 11 and rear panel 12 forming a main central pocket 70 by front to back panel bottom and side edges being sewn (stitched) with one another. The side and bottom edges of a front internal compartment panel 61 can be sewn (stitched) 100 to the bag front panel 11 to form a front internal zippered compartment 60. A zipper 40 can be stitched to the top of the panel 61 and the front panel 11 to form a main pocket 60. A main pocket 70 can be formed between front internal pocket panel 61 and rear internal pocket panel 81. A rear internal zippered compartment 80 can be formed between the rear internal compartment panel 81 having bottom and side edges sewn (stitched) 110 similar to the front internal compartment. Additional sewn lines (stitching) can be shown by main compartment zipper stitching (sewn lines) 120 and internal compartment zipper stitching (sewn lines).

Each of the plastic bags 20A, 20B and 20C can include different produce in each of the plastic bags 20A, 20B and 20C.

The novel bag 11 can be formed from cloth material having a closed bottom, closed sides that can be formed from folding a cloth material and sewing the sides together. The open top can be closed by a zipper.

A plastic bag 20 can have a sealable top, such as those found in Ziploc bags, and the like.

The inventor has done experiments with vegetables, such as but not limited to tomatoes and cucumbers, and with fruits, such as but not limited to bananas and mangos.

Through testing, bananas stored and sealed in the plastic bag 20 and then stored and closed off in the fabric bag 11 can last up to approximately 14 days without showing any spoilage. Mangoes have been shown to be able to last up to a couple of weeks before showing any spoilage.

The novel bag is a non-toxic, bio degradable, eco-friendly cover for fruits and vegetables. The consumer can place their produce in the plastic bag which is sealed, and then into the fabric bag which is zippered shut. Unlike common containers that are boxy and bulky, the novel bag provides more refrigerator space by covering only the size of the produce.

Specific sizes and dimensions of the novel bag can be made for watermelons, tomatoes, cucumbers, melons, cantaloupe, and the like.

In addition, the novel bag can be utilized to store virtually any other product.

The novel bag with stored inside plastic bag storing the produce can be stored in either the refrigerator or pantry until ready to be consumed.

Although the embodiments shown include a fabric bag with one resealable plastic bag, and a fabric bag with three compartments, the invention can be used with fabric bag having two compartments or more than three compartments and a like number of plastic bags for holding the produce piece of pieces inside.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A bag arrangement for preserving and delaying spoilage of fruits and vegetables, consisting of:

a single plastic sealable bag consisting of a single front panel layer and a single back panel layer, a closed bottom and closed sides, with a resealable fastener along an upper end, the resealable fastener consisting of an interlocking channel and track fastener, the bag being capable for storing produce therein; and a single closeable fabric bag consisting of a single front panel fabric layer and a single back panel fabric layer, both the single front panel fabric layer and the single back panel fabric layer each having with a bottom end and a top end and sides, the single front panel fabric layer being sealed by being sewn to the single back panel fabric layer along the sides and each bottom end, the top end of both the single front panel fabric layer and the single back panel fabric layer being closeable by closing a zipper, and opening the zipper which allows access to an inside compartment, wherein the inside compartment is sized for receiving only the single plastic bag with the produce, wherein the produce is preserved and spoilage is delayed, the bag arrangement in combination with produce, wherein the combination consists of only the produce in the plastic bag inside of the fabric bag.

2. The bag arrangement of claim 1, wherein the produce includes a vegetable.

3. The bag arrangement of claim 2, wherein the vegetable is a tomato.

4. The bag arrangement of claim 2, wherein the vegetable is a cucumber.

5. The bag arrangement of claim 1, wherein the produce includes a fruit.

6. The bag arrangement of claim 5, wherein the fruit is selected from at least one of a banana or a mango.

7. The bag arrangement of claim 5, wherein the fruit is selected from at least one of a watermelon, a melon or a cantaloupe.

8. The bag arrangement of claim 1, wherein the fabric panel bag consists of a left side straight exterior contiguous edge between an upper end and a lower end, a right side straight exterior contiguous edge between and upper end and a lower end, a bottom straight exterior contiguous edge between a left end and a right end, and a top straight exterior contiguous edge between a left end and a right end.

* * * * *